US005288064A

United States Patent [19]

Manabe et al.

[11] Patent Number: 5,288,064

[45] Date of Patent: Feb. 22, 1994

[54] PAPER PRESSING MECHANISM FOR PAPER FEEDING DEVICE

[75] Inventors: Nobuo Manabe; Motoaki Okitsu, both of Yamatokoriyama; Tosikazu Kitaura, Kashihara; Tomomi Tanaka; Kan Mukai, both of Yamatokoriyama, all of Japan

[73] Assignee: Sharp Kabushiki Kaisha, Osaka, Japan

[21] Appl. No.: 19,209

[22] Filed: Feb. 18, 1993

[30] Foreign Application Priority Data

Feb. 20, 1992 [JP] Japan ..... 4-69379

[51] Int. Cl.[5] ..... B65H 5/22

[52] U.S. Cl. ..... 271/3.1; 271/117; 271/163; 271/65; 271/220

[58] Field of Search ..... 271/3.1, 161, 145, 65, 271/163, 188, 207, 209, 220, 117, 118

[56] References Cited

U.S. PATENT DOCUMENTS 5,033,731 7/1991 Looney ..... 271/188 X

FOREIGN PATENT DOCUMENTS 372294 6/1990 European Pat. Off. ..... 271/65

61-178366 8/1986 Japan ..... 271/161

61-54691 11/1986 Japan .

62-215436 9/1987 Japan ..... 271/161

63-185773 8/1988 Japan ..... 271/161

*Primary Examiner*—David H. Bollinger

*Attorney, Agent, or Firm*—David G. Conlin; George W. Neuner

[57] ABSTRACT

The object of the present invention is to provide a paper pressing mechanism which performs feeding of curling sheets with a simple and compact structure. In order to realize the object, the paper pressing mechanism comprises a driving shaft 19; a paper pressing roller 15; a paper pressing arm 11 provided at both ends thereof with paper pressing portions 12, 13; and a supporting arm 17, axially supported in a rotatable manner at its one end by the driving shaft 19, and holding at the other free end the paper pressing roller 15 and the supporting arm 17 in a rotatable manner; and is characterized in that the supporting arm 17 is driven by the driving shaft 19 between a retracted position in which the mechanism is kept away from sheets of paper on a sheet table and a pressing position in which the sheets are pressed by both the paper pressing roller 15 and paper pressing portions 12,13 at the ends of the paper pressing arm 11.

5 Claims, 10 Drawing Sheets

PAPER PRESSING MECHANISM FOR PAPER FEEDING DEVICE

BACKGROUND OF THE INVENTION (1)Field of the Invention

The present invention relates to a paper pressing mechanism for paper feeding device, and particularly to a paper pressing mechanism for paper feeding device used in photocopiers having duplex copying function, etc.

(2)Description of the Related Art

In the prior art photocopiers having functions of duplex copying and composition-copying, a sheet having been provided with an image of an original is conveyed onto an intermediate tray (or sheet table) incorporated in the photocopier, and thereafter the sheet once kept on the tray is sent out once more to the copying section.

FIGS. 1 and 2 are schematically illustrative views each showing a photocopier having a different feeding route of sheets of paper. Either of the photocopiers shown in FIGS. 1 and 2 has a publicly known copying unit 50, which comprises an optical unit 51 having a light source, mirrors, lenses and other members combined, an image-formation unit 52 having a photoreceptor drum with an electrifying charger, a transfer charger, etc. disposed therearound, a developing unit 53, as part of the image-formation unit 52, including a developer container, a magnetic roller, etc., and a fixing unit 59 composed of a heat roll, a pressure roll, etc.

Arrows shown in FIGS. 1 and 2 indicate flow of sheets sent out from the fixing unit 54 after passing through the copying unit 50 constructed as above.

Of these, FIG. 1 shows a paper path for duplex copy. Paper with an image fixed thereon in the fixing unit is transferred from the copying unit 50 to a reversing unit 60. In the unit, the sheet is conveyed, as shown by arrow A, through a looping path to an intermediate tray 61 (not shown in detail). FIG. 2 shows a paper path for composition copy, in which sheets are switched back and thereafter passed through a looping path to be reversed and conveyed onto an intermediate tray 61.

FIG. 3 shows a schematically illustrative view showing a paper pressing mechanism for use in the above photocopiers. As is shown in the figure, sheets 63 are piled on the intermediate tray 61. Disposed on the upper side of an exit port 65 adjacent to the intermediate tray 61 in order to covey sheets 63 one by one, is a pick-up roller 75 axially held in a rotatable manner at a free end of a supporting arm 77 which in turn is supported rotatably by an axis 79. A paper pressing arm 71 is attached, to and rotatably together with, the supporting arm 77.

Meanwhile, as sheets 63 are conveyed to the reversing unit 60 as shown in FIG. 1 or FIG. 2, the sheets are bent through the heat roller in the fixing portion, and/or the conveying path, or curled due to hygroscopic property of the sheets, therefore the piled sheets 63 are curled up. To deal with this, the exit port 65 from the intermediate tray 61 must be designed to be higher than the height of the curl, requiring a rather large space. Even if a spacious exit port is formed, when a sheet is sent out to the exit port 65 while remaining in curl, there is still left a fear that paper jam might occur.

Description will be continued of the operation of the paper pressing mechanism shown in FIG. 3 with reference to FIGS. 4(A) and 4(B). Also in FIG. 4(A), a pick-up roller 75, is rotatably held, like what was shown in FIG. 3, at a free end of a supporting arm 77 which in turn is supported rotatably by an axis 79. A paper pressing arm 71 is attached to, and rotatable together with, the supporting arm 77. A paper pressing portion 72 at a distal end of the paper pressing arm 71 is disposed so as to be brought into contact with the sheet 63 at the same time the pick-up roller 75 comes in contact when the supporting arm 77 is rotated from a retracted position to a position where paper is pressed (FIG. 4(B)).

However, making the paper pressing portion 72 and the pick-up roller 75 abut on the sheet 63 substantially at the same instant, demands high precision of the relative position between the both, requiring troublesome labors in manufacturing and assembling.

On the other hand, Japanese Patent Publication Sho 61 No. 54691 discloses a feeding device which can perform a good re-feeding of paper stored in an intermediate paper tray by means of a paper pressing member which presses the sheets f rom the above against the tray so as to prevent the piled sheets on the intermediate tray from coming up, while guiding the sheet to a position between pair rollers upon re-feeding. This method, however, also exhibits insufficiency to prevent the sheets in pile from being fed at once, upon re-feeding of the sheets in curl, so the measure is not complete.

SUMMARY OF THE INVENTION

The present invention has been achieved under consideration of the above problems in the prior art, and it is therefore an object of the present invention to provide a paper pressing mechanism which performs feeding of curling sheets with a simple and compact structure.

The object of the invention can be achieved by a paper pressing mechanism for use in sheet feeding device, comprising: a driving shaft; a paper pressing roller; a paper pressing arm provided at both ends thereof with paper pressing portions; and a supporting arm, axially supported in a rotatable manner at its one end by the driving shaft, and holding at the other free end the paper pressing roller and the supporting arm in a rotatable manner; being characterized in that the supporting arm is driven by the driving shaft between a retracted position in which the mechanism is kept away from sheets of paper on a sheet table and a pressing position in which the sheets are pressed by both the paper pressing roller and paper pressing portions at the ends of the paper pressing arm.

In the above configuration of the invention, it is effective that a portion on the driving shaft side of the paper pressing arm is formed so as to be able to abut against the driving shaft, and the paper pressing arm is balanced in weight so as to rotate in an abutting direction against the driving shaft.

In the paper pressing mechanism stated above, it is effective that three or more pressing portions are formed on the paper pressing arm.

In the paper pressing mechanism stated above, it is effective that one or more of the plural paper pressing portions are formed into an shape elongated in a sheet feeding direction.

According to the paper pressing mechanism of the invention, it is preferable and effective that one of the paper pressing portions is formed to project toward the paper's side from an extension of a common tangent of the other paper pressing portion and the periphery of the paper pressing roller while a portion of the sheet table facing the paper pressing portion for pressing the leading end of the sheet is recessed.

In accordance with the configurations described above, since the paper pressing arm is able to rotate with respect to the paper pressing roller, it is possible to press the sheet by the paper pressing roller and the paper pressing portions without regarding to the contact of the paper pressing roller with the sheet.

DESCRIPTION OF THE PREFERRED EMBODIMENTS

Figure 1:
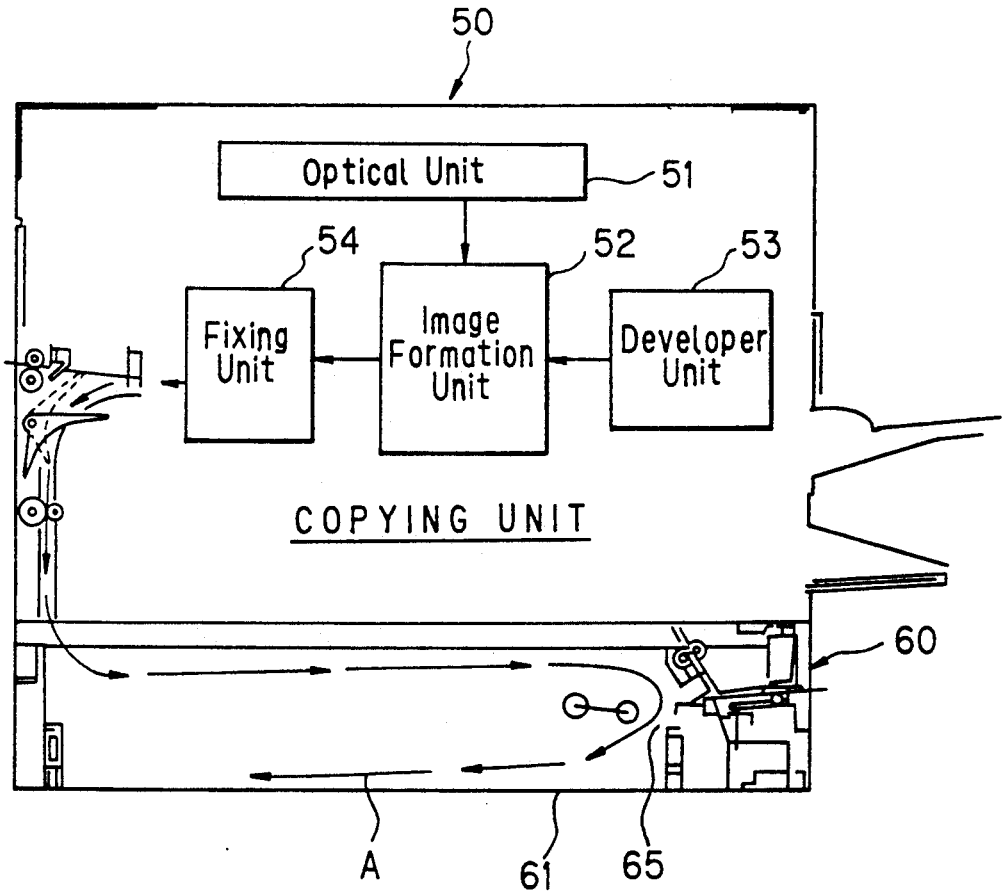
FIG. 1 is a diagram showing a sheet path when duplex copy is executed in a photocopier.
Figure 2:
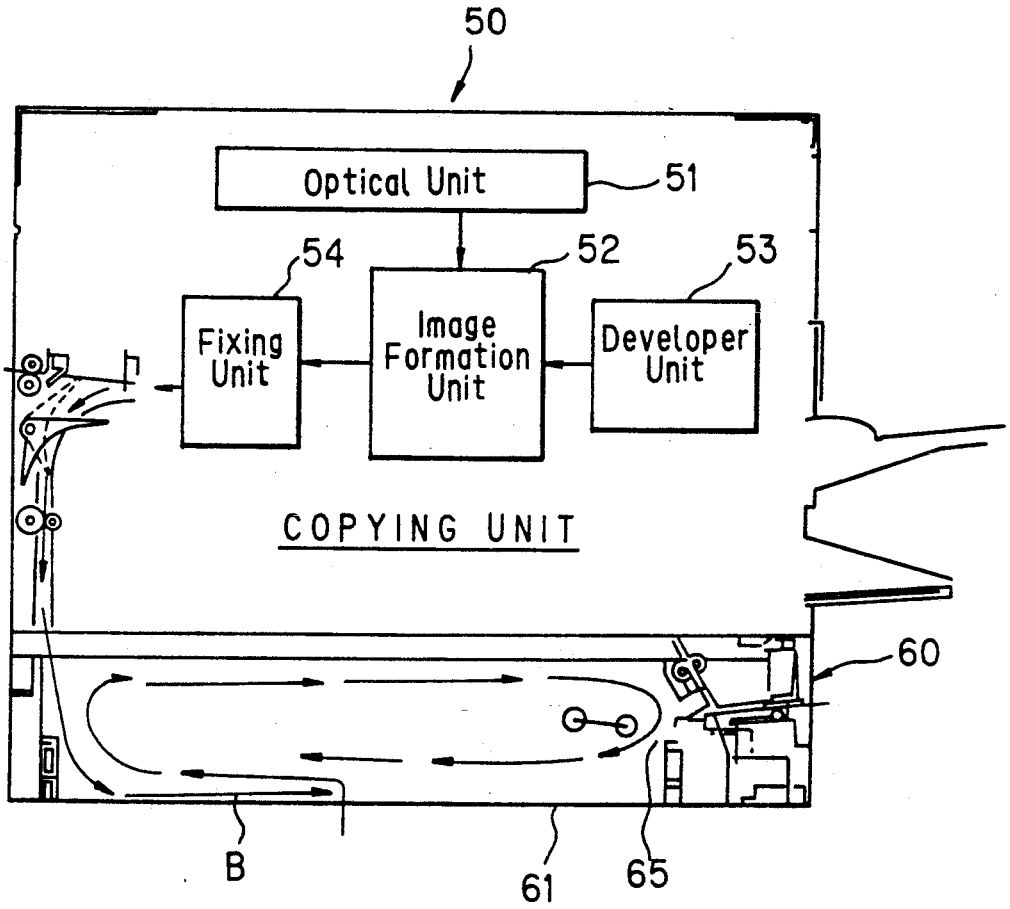
FIG. 2 is a diagram showing a sheet path when composition copy is executed in a photocopier.
Figure 3:
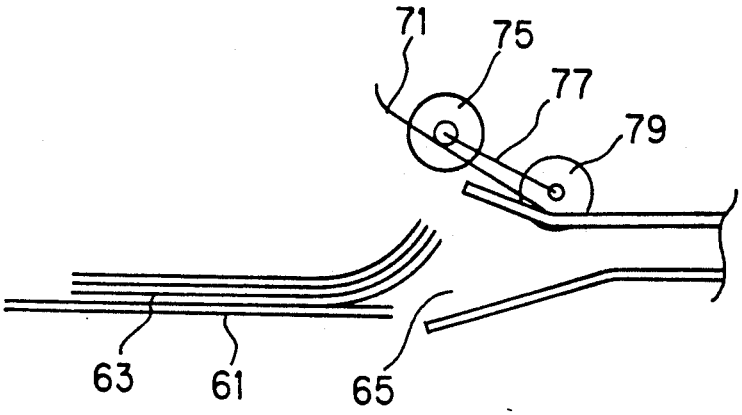
FIG. 3 is a schematic diagram showing a prior art paper pressing mechanism.
Figure 4:
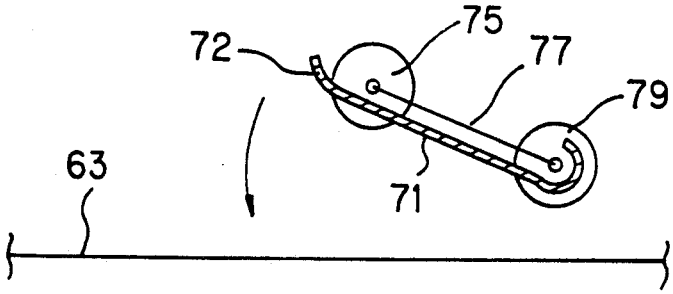
FIGS. 4 (A) and (B) are diagrams illustrating the problem of a prior art paper pressing mechanism.
Figure 4:
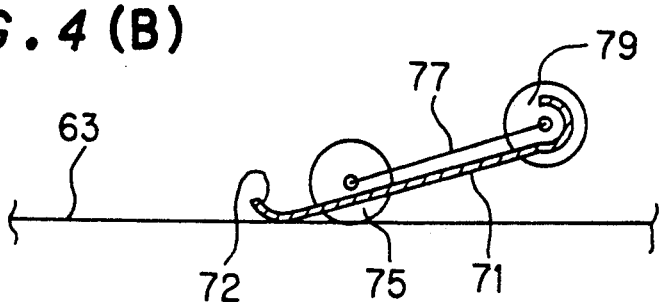
Figure 5:
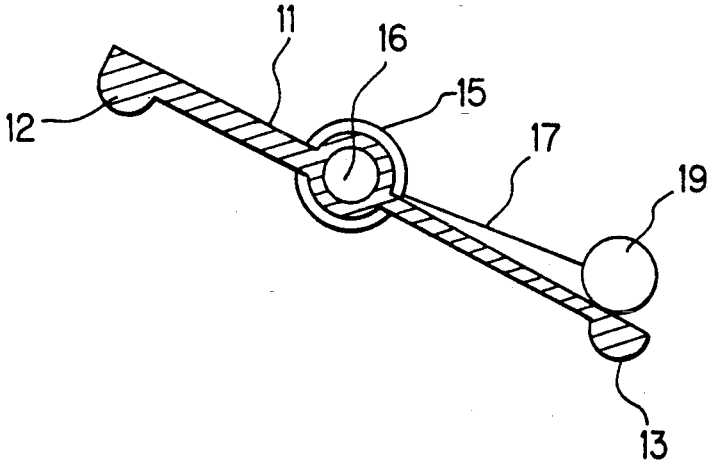
FIG. 5 is a schematic diagram showing main elements of a first embodiment of the present invention.
Figure 6:
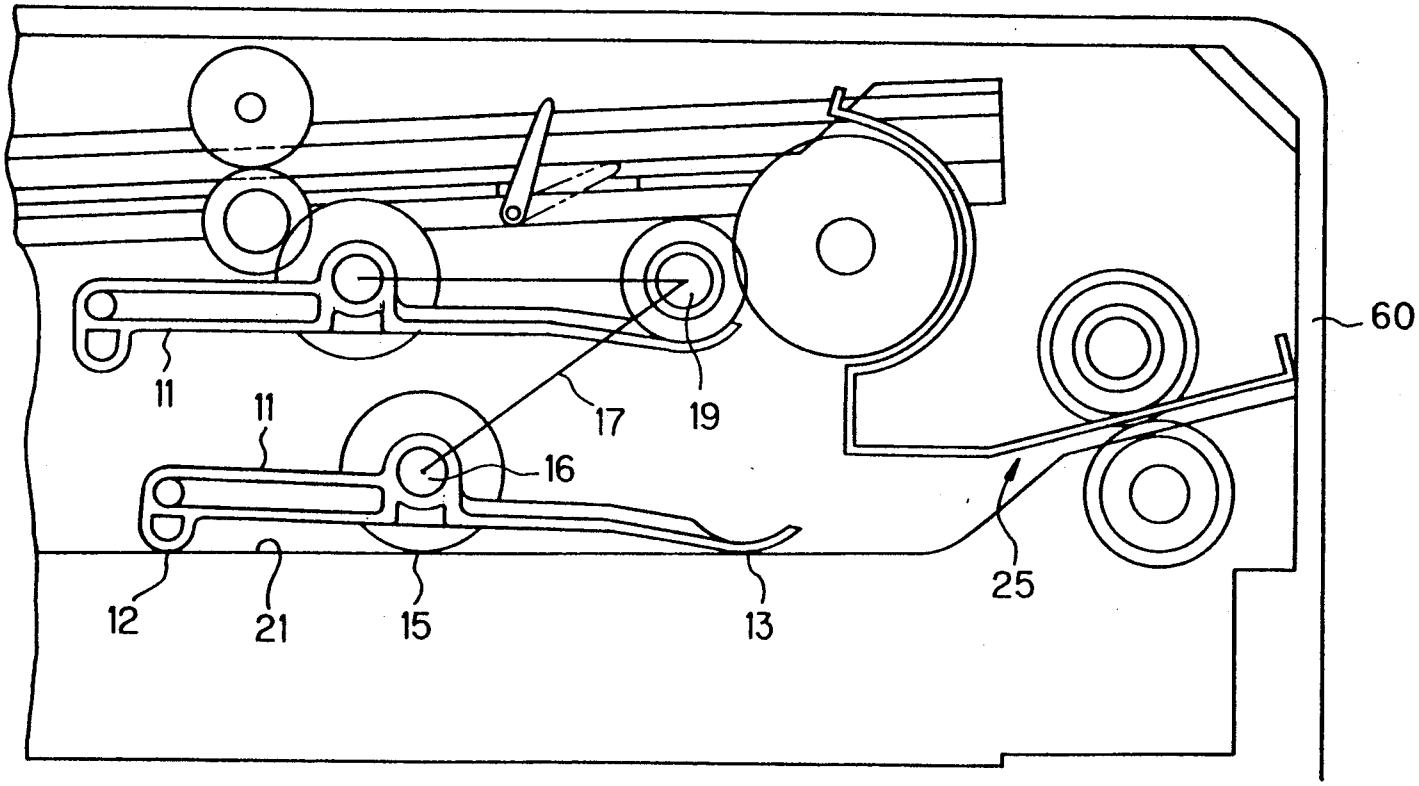
FIG. 6 is a schematic illustrative diagram showing a state in which the first embodiment is incorporated in a sheet reversing unit.
Figure 7:
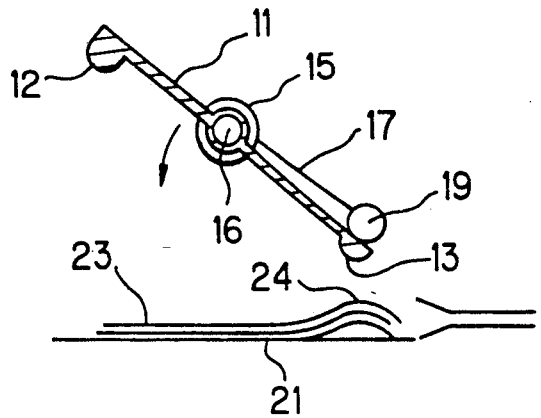
FIGS. 7(A), (B) and (C) are illustrations showing the operation of the first embodiment.
Figure 7:
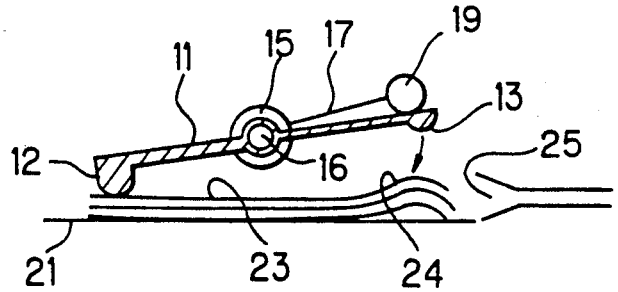
Figure 7:
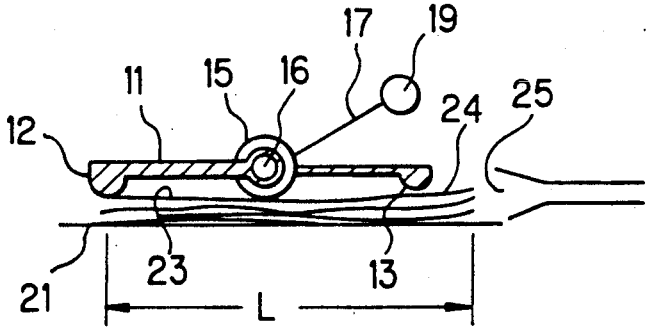

The present invention will hereinafter be described based on embodiments with reference to the accompanying drawings. FIGS. 5 and 6 are schematic cross-sectional views showing main components of a paper pressing mechanism according to a first embodiment of the present invention. FIGS. 7 (A), (B) and (C) are diagrams illustrating the operation. A paper pressing arm 11, provided with paper pressing portions 12 and 13 at respective ends, is axially held together with a paper pressing roller 15 by an axis 16 which is in turn supported at a free end of a supporting arm 17. The supporting arm 17 is axially supported by a fixed portion of a photocopier a driving shaft 19, and is rotated integrally with the driving shaft 19. Here, the paper pressing arm 11 and the supporting arm 17 are attached so as to rotate in a plane including a paper proceeding direction, and to press down the leading portion of sheets. In the following figures, the right end is assumed to be a frontward end of sheets so the sheet will be conveyed in the right direction.

The paper pressing arm 11 is weighted at the paper pressing portion 12 pressing rear side of the sheet. That is, the arm 11 is balanced in weight so that the paper pressing portion 12 comes down, and therefore, when the arm 11 is in a retracted position in which the arm 11 is spaced from the sheet, the arm 11 is kept with the upper side of the front paper pressing portion 13 abutting against the driving shaft 19. It should be noted that, in place of weight-balancing, the paper pressing arm 11 may be provided with spring means pressing thereto, or provided with a separate stopper for regulating the rotation of the paper pressing arm 11.

All of the paper pressing portions 12, 13 and the paper pressing roller 15 are arranged in a substantially identical plane so that these portions can abut onto the sheet on an intermediate tray 21 simultaneously, when the supporting arm 17 is rotated to a paper pressing position. These portions abut different positions of the sheet on the intermediate tray 21. The driving shaft 19 rotates the supporting arm 17 between the paper pressing position in which the paper pressing portions 12, 13 and the paper pressing roller 15 press down sheets and the retracted position in which the paper pressing arm 11 is spaced form the sheet. The driving shaft 19 is controlled to rotate by unillustrated controlling means and electric driving means.

Next, referring to FIGS. 7(A) to (C), the operation of the above paper pressing mechanism will be described. It will be appreciated that the paper pressing mechanism of this embodiment should be attached to a sheet reversing unit 60 like the prior art paper pressing mechanism. The supporting arm 17 keeps the paper pressing arm 11 and paper pressing roller 15 in the retracted position (refer to FIG. 7(A)) until a sheet 23 is conveyed onto the intermediate tray 21. The paper pressing arm 11 in the retracted position, is held in a state in which the paper pressing portion 13 remains abutting against the driving shaft 19.

The leading portion 24 of the sheet 23 brought onto the intermediate tray 21 curls convexly projecting upward. In such a state, the driving shaft 19 starts to rotate the mechanism toward the paper pressing position. With this movement, the paper pressing arm 11 rotates together with the supporting arm 17 with keeping the paper pressing portion 13 abutting against the driving shaft 19. Therefore, the rear paper pressing portion 12 comes at first into contact with the sheet 23 (refer to FIG. 7(B)).

The contact does not allow the paper pressing arm 11 to rotate together with the supporting arm 17, so that the arm starts to revolve mainly around a contact point of the paper pressing portion 12 with the sheet 23. Consequently, the front paper pressing portion 13 is brought into contact with the curling portion 24 of the sheet 23 to press down the portion into a plane while the paper pressing roller 15 contacts with the sheet (see FIG. 7(C)). This position is one in which the sheet is completely pressed. That is, it will be appreciated that the curling portion 24 of the sheet 23 is stretched to a plane by the paper pressing portion 13. Since the leading end portion of the sheet is thus made flat, the sheet 23 can smoothly, without jamming, enter an exit port 25 for sheet not having a widened opening.

In the above embodiment, description was made as to a case where the front end portion 24 of the sheet 23 is curled convexly projecting upward in the figure, however, this embodiment can be applied to the sheet curling opposite. Moreover, in this embodiment, since the sheet 23 is pressed down at the three point, that is, by the paper pressing portions 12, 13 and the paper pressing roller 15, the structure is valid or works well when the curl of sheet extends as long as or more than a length L from the leading edge of the sheet Lo the rear paper pressing portion 12.

Figure 8:
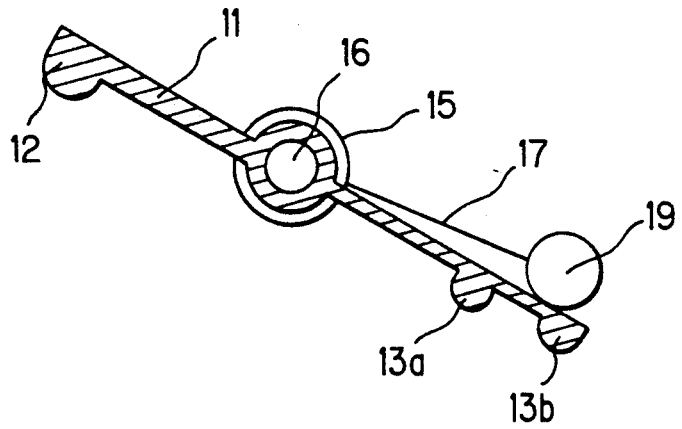
FIG. 8 is a schematic cross-sectional view showing main elements of a second embodiment of the present invention.
Figure 9:
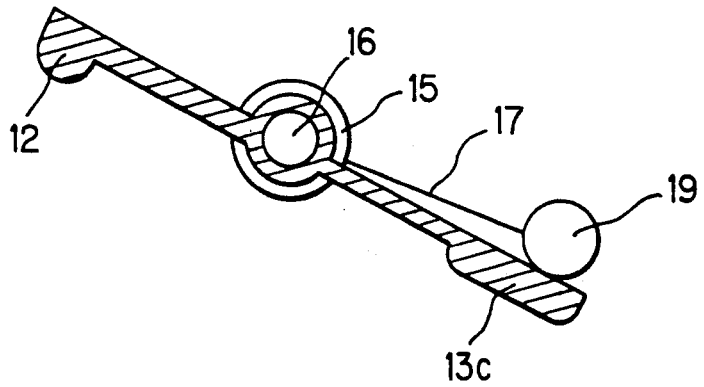
FIG. 9 is a schematic cross-sectional view showing main elements of a third embodiment of the present invention.

FIGS. 8 and 9 show different embodiments in the paper pressing arm 11. In a second embodiment shown in FIG. 8, the pressing arm 11 is provided with two paper pressing portions 13*a*, 13*b* arranged in the front side of the axis 16. In a third embodiment shown in FIG. 9, the pressing arm 11 is provided with an elongated paper pressing portion 13*c*. With these structures, a longer curl than what was treated by the structure shown in FIG. 5 can be effectively stretched. Here, in the second and third embodiment, the arm 11 is balanced in weight so that the rear side of the axis 16 is more weighted.

Figure 10:
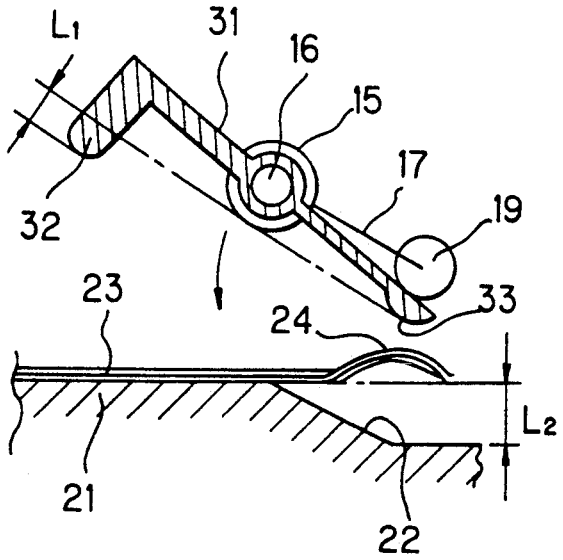
FIG. 10 is a schematic cross-sectional view showing main elements of a fourth embodiment of the present invention.
Figure 11:
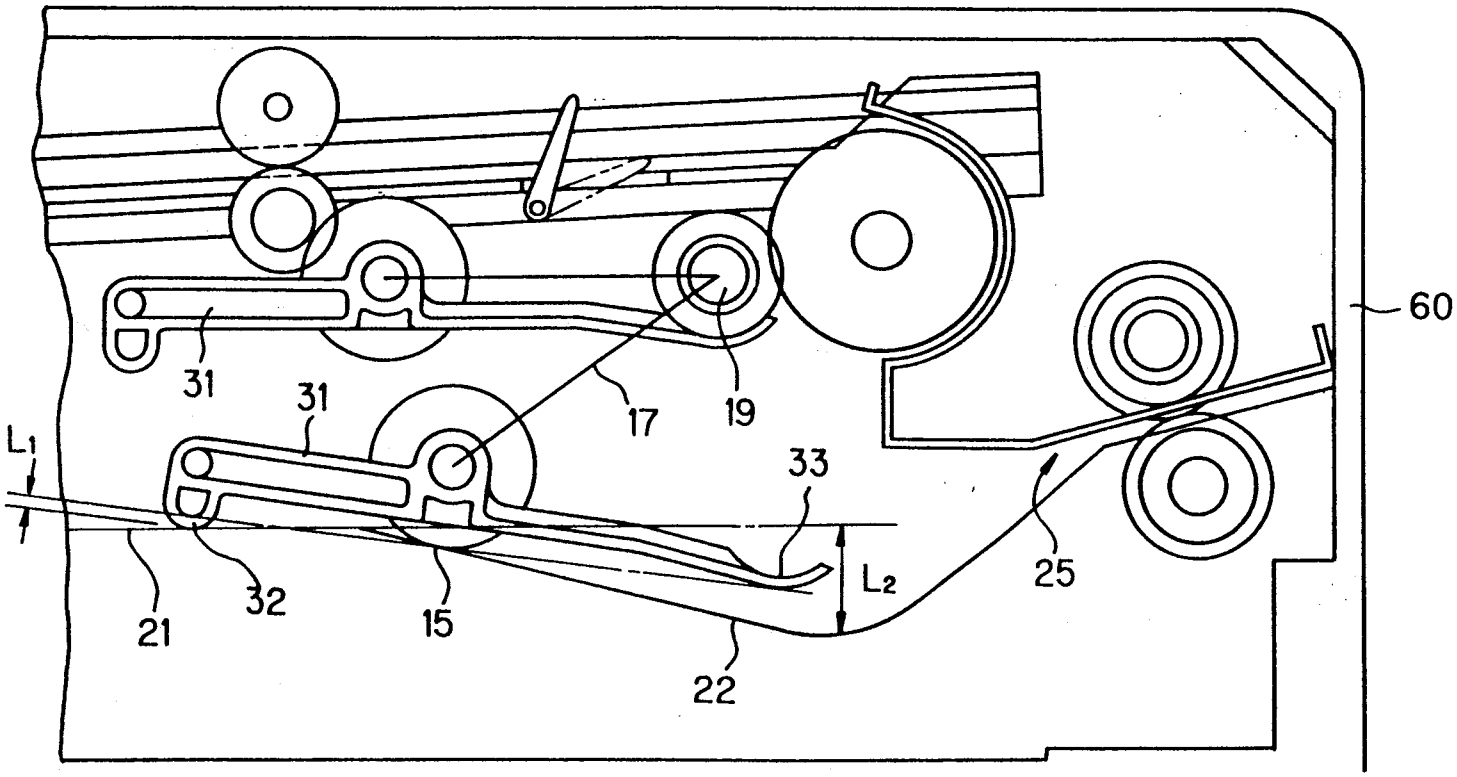
FIG. 11 is a schematic illustrative diagram showing a state in which the fourth embodiment is incorporated in a sheet reversing unit.

FIGS. 10 and 11 show a fourth embodiment. A paper pressing arm 31 of the embodiment is provided at both its ends with paper pressing portions 32, 33 having different height. More specifically, the top surface of the paper pressing portion 32 at the rear end projects toward the paper's side by a length L1 from an extension of a common tangent of the top surface of the paper pressing portion 33 at the front end and the periphery of a paper pressing roller 15, while a front end part 22 of an intermediate tray 21 is recessed by a depth L2. Here, L1 should be less than L2.

Figure 12:
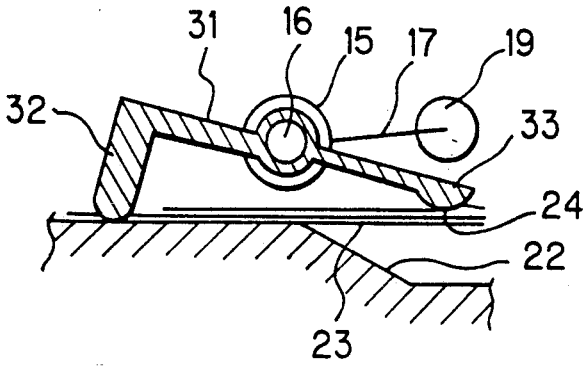
FIGS. 12 (A) and (B) are illustrations showing the operation of the fourth embodiment.
Figure 12:
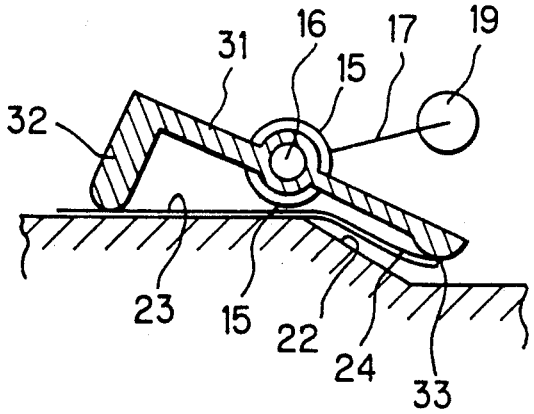

Accordingly, as shown in FIG. 12, as a supporting arm 17 rotates in a direction to press down the sheet, the rear side paper pressing portion 32 at first abuts, and then the front side paper pressing portion 33 abuts against the sheet 23. Still at this state, the paper pressing roller 15 has not yet abutted on the sheet 23 (see FIG. 12(A)). A further rotation of the supporting arm 17, enforcing the pressure of the paper pressing portions 32, 33 upon the sheet, brings down the paper pressing roller 15, to at last come into contact with the sheet 23 (see FIG. 12(B)). In this state, curling portion 24 of the sheet 23 is bent opposite receiving a stronger correcting force, so that it is effective, in particular, when the end portion is curled convexly.

As apparent from what has been illustrated above, according to the present invention, since the paper pressing arm is able to rotate with respect to the paper pressing roller, it is possible to press the sheet by the paper pressing roller and the paper pressing portions without regarding to the contact of the paper pressing roller with the sheet. Accordingly, the present invention makes it possible to effectively flat sheets having curls of various kinds and different lengths, and nevertheless, there is no need for manufacturing and assembling the mechanism with high precision.

What is claimed is:

1. A paper pressing mechanism for use in sheet feeding device, comprising:

a driving shaft;

a paper pressing roller;

a paper pressing arm provided at both ends thereof with paper pressing portions; and a supporting arm, axially supported in a rotatable manner at its one end by said driving shaft, and holding at the other free end said paper pressing roller and said supporting arm in a rotatable manner;

being characterized in that said supporting arm is driven by said driving shaft between a retracted position in which the mechanism is kept away from sheets of paper on a sheet table and a pressing position in which the sheets are pressed by both said paper pressing roller and paper pressing portions at the ends of said paper pressing arm.

2. A paper pressing mechanism for use in sheet feeding device according to claim 1, wherein a portion on the driving shaft side of said paper pressing arm is formed so as to be able to abut against said driving shaft, and said paper pressing arm is balanced in weight so as to rotate in a abutting direction against said driving shaft.

3. A paper pressing mechanism for use in sheet feeding device according to claim 1 or 2, wherein three or more pressing portions are formed on said paper pressing arm.

4. A paper pressing mechanism for use in sheet feeding device according to claim 1 or 2, wherein one or more of said plural paper pressing portions are formed into an shape elongated in a sheet feeding direction.

5. A paper pressing mechanism for use in sheet feeding device according to claim 1 or 2, wherein one of said paper pressing portions is formed to project toward the paper's side from an extension of a common tangent of the other paper pressing portion and the periphery of said paper pressing roller while a portion of the sheet table facing the paper pressing portion for pressing the leading end of the sheet is recessed.

* * * * *